United States Patent [19]

Ping

[11] Patent Number: 4,983,094

[45] Date of Patent: Jan. 8, 1991

[54] LOAD LIFTING ATTACHMENT

[75] Inventor: David T. Ping, Mentor, Ohio

[73] Assignee: Caterpillar Industrial Inc., Mentor, Ohio

[21] Appl. No.: 886,993

[22] Filed: Jul. 18, 1986

[51] Int. Cl.[5] ..... B66C 1/66

[52] U.S. Cl. ..... 414/621; 294/81.1

[58] Field of Search ..... 414/607, 621, 626; 294/81.1, 81.4

[56] References Cited

U.S. PATENT DOCUMENTS

| | | | |
|---|---|---|---|
| 3,088,505 | 5/1963 | Pearson | 414/626 X |
| 3,513,999 | 5/1970 | Schwartz et al. | 214/394 |
| 3,570,695 | 3/1971 | Schwartz . | |
| 3,633,777 | 1/1972 | Snelling et al. | 214/621 |
| 3,764,032 | 10/1973 | Ward | 294/81.4 X |
| 3,870,180 | 3/1975 | Snelling et al. | 214/621 |
| 3,982,644 | 9/1976 | Pease | 294/81.4 X |
| 4,016,992 | 4/1977 | Larsen et al. | 214/147 G |
| 4,017,110 | 4/1977 | Pease | 414/607 X |
| 4,487,106 | 12/1984 | Field, Jr. . | |

FOREIGN PATENT DOCUMENTS

| | | | |
|---|---|---|---|
| 1556324 | 2/1970 | Fed. Rep. of Germany . | |
| 2721947 | 11/1978 | Fed. Rep. of Germany . | |
| 3007901 | 9/1981 | Fed. Rep. of Germany . | |
| 2161553 | 7/1973 | France . | |
| 1209383 | 10/1970 | United Kingdom | 414/607 |
| 1423513 | 2/1976 | United Kingdom . | |

*Primary Examiner*—Peter A. Aschenbrenner
*Attorney, Agent, or Firm*—Alan J. Hickman

[57] ABSTRACT

Yieldably suspended attachments for lifting trailers or containers are difficult to accurately position. Therefore, load pick-up and deposit is inefficient and inaccurate. A load lifting attachment having an elevationally movable connecting frame, a load engaging frame having first and second end portions, and first and second link assemblies yieldably connecting the load engaging frame to the connecting frame first end portion is provided. A connecting arrangement connects the load engaging frame second end portion to the connecting frame, maintains the load engaging frame for free elevational movement relative to the connecting frame, and controllably moves the load engaging frame second end portion between elevationally spaced apart locations relative to the connecting frame. Therefore, the aforementioned problems related to the positioning of the load lifting attachment are alleviated. The load lifting attachment is particularly suited for use on a material handling vehicle having a lift mast.

18 Claims, 4 Drawing Sheets

12
16
18
18
16
102
116
30
32,34
104
96
94
202
84,90
206
98
28
68
72
82,88
72
78
96
106,108
78
40
100
42
68
70
86,92
36
48
52
70
94
76
76
44
54
56
56
74
74
46
27
38
26

166
166
164
158
156
104
162
160
154
134
112
134
152
150
124
130
132
152
148
170
200
118
146
110
142
120
122
204
140
144
146
148
128
126
136
138
172
114
168
162
116

LOAD LIFTING ATTACHMENT

DESCRIPTION

1. Technical Field

This invention relates to a load lifting attachment for use on a material handling vehicle and, more particularly, to a load lifting attachment having an elevationally movable carriage and a load engaging frame having first and second end portions which are connected to the carriage and controllably elevationally movable relative to the carriage between spaced apart elevational locations.

2. Background Art

Load lifting attachments of the type suitable for engaging and lifting a load, for example, containers and trailers, are well-known in the art. Some examples of container lifting attachments are shown in U.S. Pat. Nos. 3,513,999 dated May 26, 1970 to W. H. Schwartz et al., No. 3,633,777 dated Jan. 11, 1972 to Murdock and Snelling Jr. et al., and No. 3,870,180 dated Mar. 11, 1975 to Murdock and Snelling Jr.. An example of a trailer handling attachment is shown in U.S. Pat. No. 4,016,992 dated Apr. 12, 1977 to Richard L. Larson et al. In each of these patents, a load engaging frame is mounted on the vehicle and elevationally movable in order to engage a load to be lifted and subsequently lift, transport, and deposit the load at a preselected location.

As shown in the above-noted patents, the load lifting attachment has a load engaging frame which has a plurality of load engaging members suitable for connecting the load engaging frame to a container or a trailer to be lifted. The load engaging frame is normally connected to the vehicle and elevationally movable relative to the vehicle between elevationally spaced apart locations. In U.S. Pat. No. 3,513,999, the load engaging frame is pivotally connected to the frame of a straddle carrier by a plurality of telescopic jacks which are extensible to move the load engaging frame into engagement with a container to be lifted and retractable to lift the load for transportation purposes. Frequently, the load to be lifted is out of level (not parallel) relative to the load engaging frame which poses a problem since not all of the load engaging members are in engagement with the load to be lifted. The load may not be lifted until each of the load engaging members are connected to the load.

The above-noted Pat. Nos. 3,633,777, 3,870,180, and 4,016,992 address themselves to this problem of engagement between the load engaging members of a container handling attachment and the load to be lifted when the load to be lifted is not level with the load engaging frame. A plurality of yieldable connecting link assemblies connect the load engaging frame to a connecting frame which is elevationally movably mounted on the vehicle. The yieldable connecting link assemblies permit free movement between the load engaging frame and connecting frame and allows the load engaging frame to be set down on top of the container to be lifted. Thus, the yieldable connecting assemblies allow engagement of the load engaging members with the load so that they may be securely connected to the load. However, since the yieldable connecting link assemblies are not controllable, positioning of the load engaging frame relative the load to be lifted is extremely difficult and time-consuming. Thus, an exceptionally skilled vehicle operator must be provided in order to position the load engaging frame properly.

In trailer handling applications wherein a trailer is to be deposited on a railroad flatcar, it is necessary for the operator to engage a hitch ball on the trailer with a socket stantion on the flatcar so that the trailer is locked in place on the flatcar for transportation purposes. State of the art devices, as represented by the above-noted patents, do not provide any means for selectively controlling the elevational position of one end of the load engaging frame relative to the connecting frame so that the trailer ball may be engaged with the stantion prior to accurate positioning of an end of the trailer opposite the ball relative to the flatcar and prior to depositing the trailer on the flatcar.

The present invention is directed to overcoming one or more of the problems as set forth above and provide a load lifting attachment which permits selective elevational positioning of at least one end portion of the load engaging frame relative to the carriage and provides free elevational movement of the first and second end portions of the load engaging frame so that each of the load engaging members may be lockingly connectingly engaged with the load to be lifted.

DISCLOSURE OF THE INVENTION

A load lifting attachment having a carriage, and a load engaging frame having first and second spaced apart end portions and a plurality of load engaging members is provided. A first link assembly having first and second spaced apart end portions which are freely elevationally movable relative to each other is pivotally connected at the first link assembly first end portion to the connecting frame and at the first link assembly second end portion to the load engaging frame first end portion. A second link assembly having first and second spaced apart end portions which are freely elevationally movable relative to each other is pivotally connected at the second link assembly first end portion to the connecting frame and at the second link assembly second end portion to the first end portion of the load engaging frame. A connecting means connects the load engaging frame second end portion to the connecting frame, maintains the load engaging frame for free elevational movement relative to the connecting frame, and controllably moves the load engaging frame second end portion between elevationally spaced apart locations relative to the connecting frame.

In another aspect of the present invention, a material handling vehicle having an end portion, a lift mast pivotally connected to the vehicle end portion, a carriage mounted on the lift mast and elevationally movable along the lift mast between elevationally spaced apart locations on the lift mast, and a load engaging frame having a plurality of spaced apart pivotally movable load engaging members is provided. The carriage has a connecting frame and the connecting frame has an arm portion which extends in a direction transverse to the lift mast. A first link assembly having a body, a longitudinal axis, and a rod slidably connected to the body and movable relative to the body along the longitudinal axis between extended and retracted positions is provided. The first link assembly rod has an end portion and is pivotally connected at the first link assembly rod end portion to one of the arm portion and load engaging frame and the body has an end portion and is pivotally connected at the first link assembly body end portion to the other of the arm portion and load engaging frame. A second link assembly having a body, a longitudinally axis, and a rod slidably connected to the body and movable relative to the body along the longitudinal axis between an extended position and a retracted position is provided. The second link assembly rod has an end portion and is pivotally connected at the second link assembly rod end portion to one of the arm portions and load engaging frame. The second link assembly body has an end portion and is pivotally connected at the second link assembly body end portion to the other of the arm portion and load engaging frame. A third link assembly having a body, a longitudinal axis, and first and second rods slidably connected to the body is provided. The third link assembly first and second rods each are extensibly movable along the third link assembly longitudinal axis between an extended position and a retracted position relative to the third link assembly body. The third link assembly first and second rods each have an end portion, and the third link assembly first rod end portion is pivotally connected to one of the arm portion and load engaging frames, and the third link assembly second rod end portion is pivotally connected to the other of the arm portion and the load engaging frame. One of the third link assembly first and second rods is freely extensibly movable along the third link assembly longitudinal axis between the extended and retracted positions, and the other of the third link assembly first and second rods is controllably extensibly movable along the third link assembly longitudinal axis between the extended and retracted positions. A fourth link assembly having a body, a longitudinal axis, and first and second rods slidably connected to the body is provided. The fourth link assembly first and second rods each are extensibly movable along the fourth link assembly longitudinal axis between an extended position and a retracted position relative to the fourth link body. The fourth link assembly first and second rods each have an end portion, and the fourth link assembly first rod end portion is pivotally connected to one of the arm portion and load engaging frame, and the fourth link assembly second rod end portion is pivotally connected to the other of said arm portion and load engaging frame. One of the fourth link assembly first and second rods is freely extensibly movable along the fourth link assembly longitudinal axis between the extended and retracted positions, and the other of the fourth link assembly first and second rods is controllably extensibly movable along the fourth link assembly longitudinal axis between the extended and retracted positions. A selective delivery means is provided for selectively delivering pressurized fluid flow to the third and fourth link assemblies and for controllably moving the first rod of the third and fourth link assemblies between the extended and retracted positions.

The load lifting attachment of the subject invention provides controllable positioning of the second end portion of the load engaging frame and a preselected amount of free elevational movement of the first and second end portions of the load engaging frame relative to the carriage.

BEST MODE FOR CARRYING OUT THE INVENTION

Figure 1:
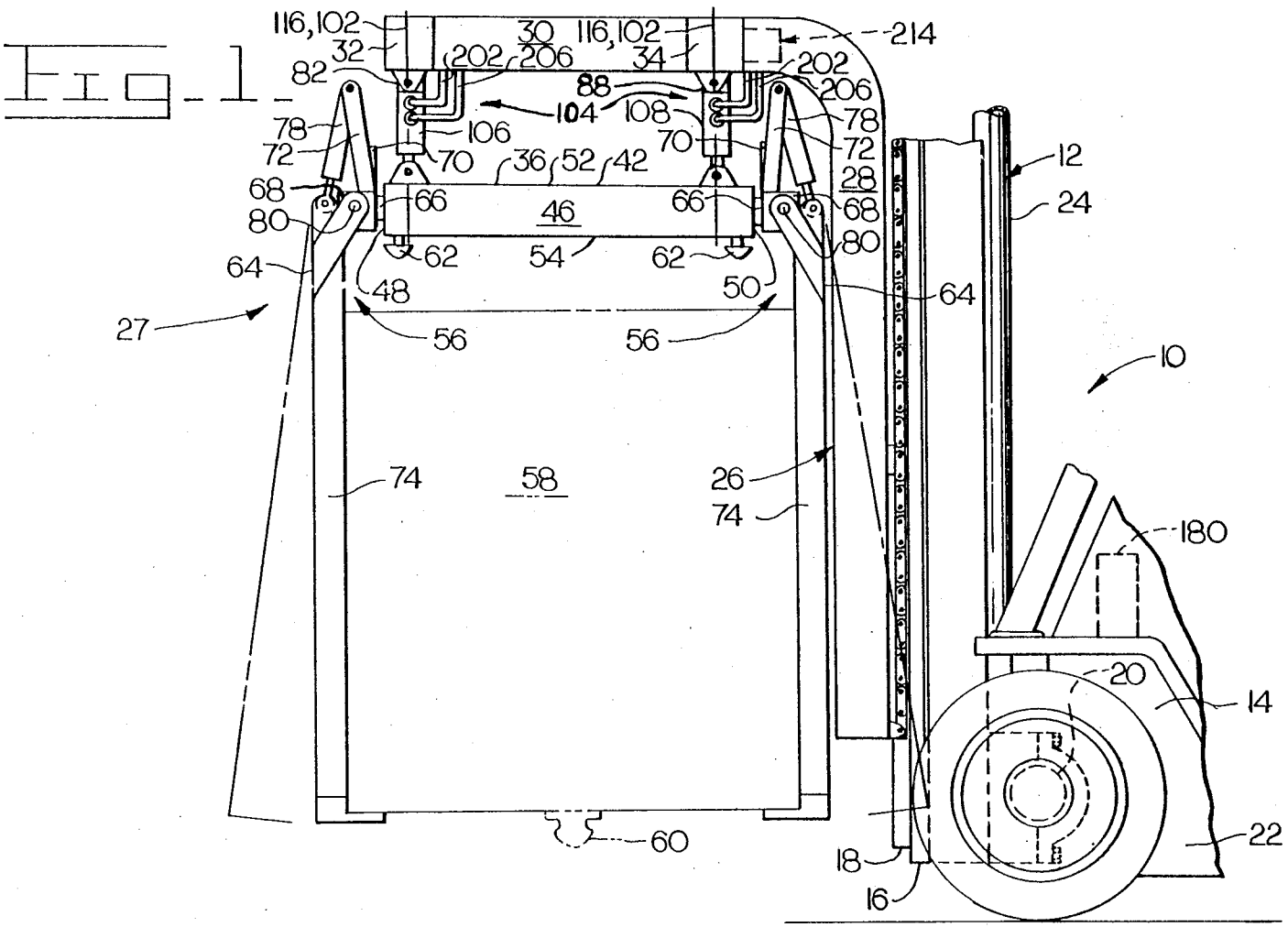
FIG. 1 is a partial diagrammatic side elevational view of a material handling vehicle showing a lift mast assembly mounted on one end portion of the vehicle and a load lifting attachment mounted on the lift mast.
Figure 2:
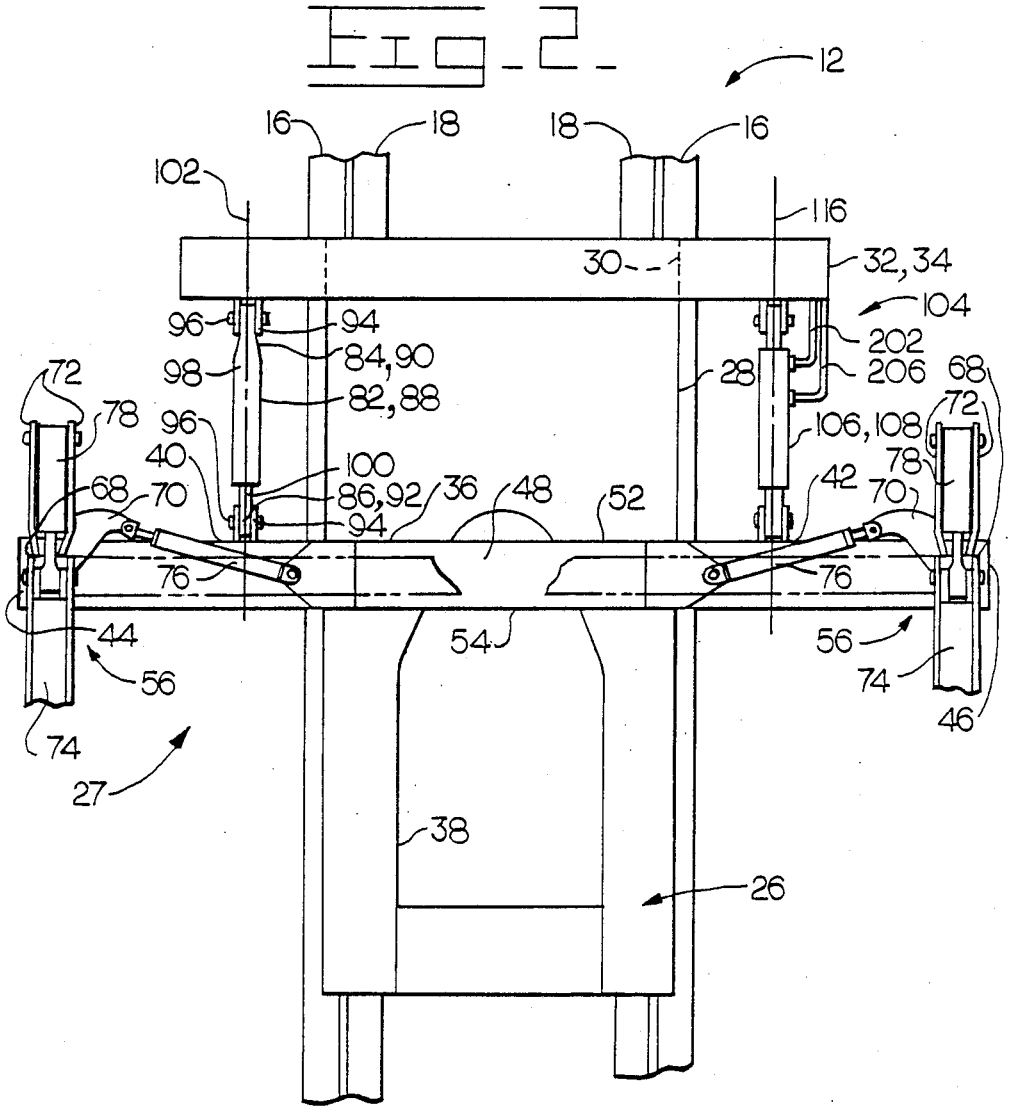
FIG. 2 is a diagrammatic partial front elevational view of the lift mast assembly and load lifting attachment of FIG. 1.

With reference to FIGS. 1 and 2, a material handling vehicle 10, for example, a lift truck, has a lift mast 12 pivotally mounted on an end portion 14 of the vehicle 10. The lift mast 12 has a pair of spaced apart substantially parallel outer uprights 16 and a pair of spaced apart substantially parallel inner uprights 18 which are mounted on and between the pair of outer uprights 16 and elevationally movable along the outer pair of uprights 16. The outer uprights 16 are preferably connected at the vehicle end portion 14 to axle housing 20 in any conventional manner. Alternately, the pair of outer uprights 16 may be connected to the frame 22 of the vehicle 10 in any suitable and well-known manner. A pair of lift jacks 24, only one of which is shown, are connected at opposite ends (not shown) to the fixed and movable uprights, respectively, in a conventional manner. A chain and reeving arrangement of a conventional form is provided to elevationally move a carriage of a load lifting attachment 27 along the inner uprights 18 between elevationally spaced apart locations in response to elevational movement of the lift jacks 24.

The carriage 26 is mounted on the inner uprights by a plurality of load and side thrust rollers (not shown). Since the mounting of carriage 26 to the inner uprights 18 is achieved in a conventional and well-known manner to those skilled in the art, no further discussion will be provided. The carriage 26 has a connecting frame 28 which has an arm portion 30. The arm portion 30 extends from the carriage 26 in a direction transverse of the lift mast inner and outer uprights 18,20 and outwardly from the vehicle end portion 14. The connecting frame 28 also has first and second cross beams 32,34 which are connected to the arm portion 30 at spaced apart locations therealong and extend therefrom in a direction transverse the arm portion 30. The cross beams 32,34 are preferably welded to the arm portion 30, extend a preselected distance from the arm portion 30 and provide for connection of a load engaging frame 36 thereto. The connecting frame 28 is preferably rectangular in cross section along its length and along the arm portion 30 thereof. A cutout 38 is provided in the carriage 26 to reduce weight, where possible, without reducing strength. Although the first and second cross beams 32,34 are shown as being rectangular in cross section, other cross sections such as "T" or "I" would be suitable substitutes. The load engaging frame 36 has a substantially rectangular elongate shaped configuration and first and second spaced apart end portions 40,42. The load engaging frame 36 is telescopically extendable in the transverse direction relative to the arm portion 30 to provide length adjustments for engagement with a plurality of different sized loads 58. The load engaging frame 36 has first, second, third, and fourth sides 44,46,48,50, a top 52, and a bottom 54. A plurality of load engaging members 56 are pivotally connected to the load engaging frame 36 at spaced apart locations thereon and provide locking engagement between the load engaging frame 36 and the load 58 to be lifted. The load 58 is shown as a trailer having a hitch ball 60 connected at one end portion of the trailer for hitching purposes with an on highway tractor or a stantion of a flatbed railroad car.

The load engaging frame 36 is capable of picking up either containers or trailers. To achieve this dual capability, the load engaging members 56 include container handling twist locks 62 and trailer handling clamps 64. The twist locks 62 are spade shaped devices which are rotatably mounted on the load engaging frame 36. The twist locks 62 extend from the bottom 54 of the load engaging frame 36 a preselected distance sufficient for engaging locking slots (not shown) located at each of the upper corner end portions of the container to be lifted. Specifically, the twist locks 62 are four in number and are mounted on the load engaging frame at locations adjacent the corners of the load engaging frame defined at the juncture of intersection between the first and second sides 44,46 and the third and fourth sides 48,50 of the load engaging frame 36.

The clamps 64, which total four in number, are pivotally connected to the load engaging frame 36. Two of the four clamps 64 are pivotally connected to the third side 48 of the load engaging frame 36 at spaced apart locations thereon, and the other two of the four clamps 64 are pivotally connected to the fourth side 50 of the load engaging frame 36 at spaced apart locations thereon. The load engaging clamps 64 each include a shaft 66, a carrier 68 having first and second lever arms 70,72, a clamp arm 74, and first and second fluid operated jacks 76,78. The shaft 66 rotatably connects the carrier 68 to the load engaging frame 36 at the spaced apart locations on each of the third and fourth sides as previously mentioned. The first jack 76 is pivotally connected between the first lever arm 70 and the load engaging frame 36, and the second jack 78 is pivotally connected between the second lever arm 72 and the clamp arm 74. A first shaft 80 pivotally connects the clamp arm 74 to the carrier 68. The clamp arm 74 is pivotally movable about the shaft 80, in response to extension or retraction of the second fluid operated jack 78, for moving in directions towards and away from the lift mast 12 between a clamping position at which the clamp arms 74 are forceably engaged with the trailer 58 and a releasing position at which the clamp arms 74 are spaced from the trailer 58 and the trailer 58 is free from connection with the clamp arms 74. The first fluid operated jack 76 pivots the carrier 68 about the shaft 66 between a storing position at which the clamp arm 74 is pivoted upwardly towards the load engaging frame 36 so that the twist locks 62 may be engaged with a cargo container, and an operative position at which the clamp arms 74 are positioned to pivotally engage the trailer 58 in response to movement of the second jack 78 in said previously discussed manner. In the drawing of FIG. 1, the clamp arms 74 are shown in solid lines at the trailer clamping position and in phantom lines at the trailer releasing position. In the drawing of FIG. 2, the clamp arms 74 are shown in phantom lines in the stored position and in solid lines in the operative position.

A first link assembly 82 having first and second spaced apart end portions 84,86 is pivotally connected at the first end portion 84 to the connecting frame 28 and at the second end portion 86 to the load engaging frame first end portion 40. The first and second end portions 84,86 are freely elevationally movable relative to each other. A second link assembly 88 having first and second spaced apart end portions 90,92 is pivotally connected at the first end portion 90 to the connecting frame 28, and at the second end portion 92 to the first end portion 40 of the load engaging frame 36. In the same manner as the first link assembly 82, the second link assembly first and second end portions 90,92 are freely elevationally movable relative to each other. The first and second link assemblies 82,88 are connected to the first end portion 40 of the load engaging frame 36 at spaced apart locations on the load engaging frame 36. Preferably, the first link assembly 82 is pivotally connected at the first end portion 84 to the first cross beam 32 and at the second end portion 86 to the load engaging frame top 52 at a location closely adjacent the third side 48 of the load engaging frame 36. Similarly, the second link first end portion 90 is pivotally connected to the second cross beam 34 and at the second link second end portion 92 to the load engaging frame top 52 at a location closely adjacent the load engaging frame fourth side 50.

Due to the identical construction of the first and second link assemblies 82,88, only one will be discussed in detail; however, it is to be understood that any discussion with respect to one also relates to the other. The first and second end portions 84,86 of the first link assembly 82 and the first and second end portions 90,92 of the second link assembly 88 are universally pivotally connected to the connecting and load engaging frames 28,36 via a spherical ball and seat (not shown), a clevis 94, and a pin 96. Details of the spherical ball and seat will subsequently be discussed in greater detail. The first and second link assemblies 82,88 each have a cylindrical tubular body portion 98, a cylindrical rod 100 slidably disposed in the tubular body portion 98, and a longitudinal axis 102. The cylindrical rod 100 is freely telescopically movable relative to the body 98 between extended and retracted positions so that the distance between the connecting frame arm portion 30 and the load engaging frame 36 may be varied to accommodate complete contact between the load engaging frame 36 and the load 58 to be lifted.

Means 104 is provided for connecting the load engaging frame second end portion 42 to the connecting frame 28, for maintaining the load engaging frame second end portion 42 for free elevational movement relative to the connecting frame 28, and for controllably moving the load engaging frame second end portion 42 between elevationally spaced apart locations relative to the connecting frame 28. Connecting means 104 includes third and fourth link assemblies 106,108. The third link assembly 106 is preferably pivotally connected to the first cross beam 32 at a location thereon spaced from the first link assembly 82, and pivotally connected to the load engaging frame top 52 at a location on the load engaging frame second end portion 42 spaced from the first link assembly 82, and adjacent the load engaging frame third side 48. The fourth link assembly 108 is pivotally connected to the second cross beam 34 at a location spaced from the second link assembly on the second cross beam 34 and pivotally connected to the second end portion 42 of the load engaging frame 36 at a location on the load engaging frame 36 spaced from the second link assembly 88 and closely adjacent the load engaging frame fourth side 50. It is to be noted that the third and fourth link assemblies 106,108 are spaced from each other at the connection on the second end portion 42 of the load engaging frame 36 and located between the respective cross beam 32,34 and the load engaging frame 36.

Since the third and fourth link assemblies 106,108 are identically constructed and identically connected to the connecting and load engaging frames 28,36, only the third link assembly 106 will be discussed in detail. However, all subsequent discussion related to the third link assembly also pertains to the fourth link assembly 108.

Figure 3:
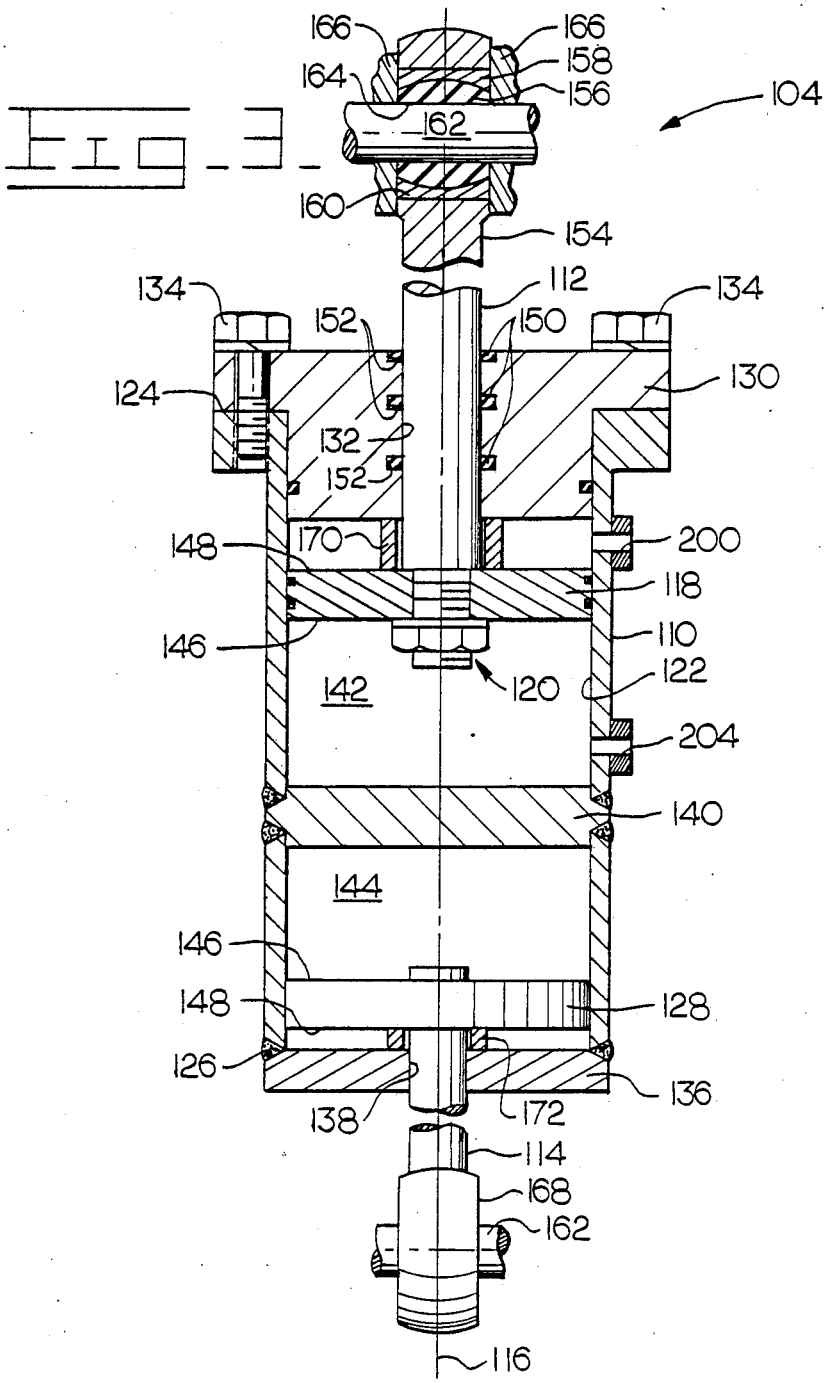
FIG. 3 is a diagrammatic cross-sectional view taken along lines III—III of FIG. 1 showing a third link assembly of the connecting means in greater detail.

With reference to FIG. 3, the third link assembly 106, which is identical to the fourth link assembly 108, has a body 110 and first and second rods 112,114 slidably connected to the body 110. Each of the first and second rods 112,114 are movable along a common longitudinal axis 116 between an extended position and a retracted position relative to the body 110. The first rod 112 is connected to a piston 118 by a fastener 120. The piston 118 is slidably disposed in a bore 122 in body 110 which opens at first and second opposed ends 124,126 of the body. A second piston 128 is attached to the second rod 114 and slidably disposed in body bore 122. The second piston 128 is secured to second rod 114 in any suitable manner, such as by welding, a threaded fastener, and the like. A first end cap 130 having a first aperture 132 disposed therethrough is connected to the body at the first end 124 thereof via a plurality of fasteners 134. The first rod 112 is slidably disposed in the first aperture 132 and extends from the bore 122 through the second aperture 122 to a location past the first end cap 130. A second end cap 136 having a second aperture 138 disposed therethrough is connected in any suitable manner such as by welding to the second end 126 of body 110. The second rod 114 is slidably disposed in the second aperture 138 and extends from the bore 122 through the second aperture 138 to a location past the second end cap 136. A dividing member 140 is disposed in the bore 122 and secured to the body 110 by any suitable technique such as by welding. The dividing member 140 is positioned along the longitudinal axis 116 between the first and second ends 124,126 of the body 110 and defines first and second chambers 142,144 with the body 110 and the first and second end caps 130,136.

The first and second pistons 118,128 each have a head end 146, a rod end 148, and are movable between a first position at which the head end 146 is adjacent the dividing member 140, and a second position spaced from the first position at which the rod end 148 of the first piston 118 is adjacent the first end cap, and the second piston rod end 148 is adjacent the second end cap 136. The first and second rods 112,114 are at the retracted position in response to the first and second pistons 118,128, respectively, being at the first position. The first rod 112 is at the extended position in response to the first piston 118 being at the second position, and the second rod 114 is at the extended position in response to the second piston 128 being at the second position. The first and second rods 112,114 lie and extend along common axis 116.

A plurality of seals 150 are disposed in annular grooves 152, an end cap 130, and sealingly engage the first rod 112 to prevent fluid leakage from passing from chamber 142 along the first rod 112. Dividing member 140 seals the first chamber 142 from the second chamber 144 and prevents leakage of fluid from the first chamber 142 to the second chamber 144.

The first rod 112 has an end portion 154 which is disposed outside the first chamber 142. End portion 154 is connected to the arm portion 30 of connecting frame 28 by a spherical ball 156 which is matingly engaged with a spherical seat 158 disposed in a bore 160 in the first rod end portion 154. A pin 162 is disposed in an aperture 164 in spherical ball 156 and extends therethrough to connect the spherical ball 156 to a clevis 166 mounted on the arm portion 30 of the connecting frame 28. As it can be recognized, the spherical ball and seat 156,158 permits universal pivotal movement of the first rod 112 relative to the connecting frame 28. A similar spherical ball 156 and spherical seat 158 connection is also used to universally pivotally connect the first and second end portions 84,90,86,92 of the first and second link assemblies 82,88 to the load engaging and connecting frames 36,28.

The second rod 114 also has an end portion 168 which is universally pivotally connected to the load engaging frame 36 at the aforementioned location in a manner identical to that just discussed with respect to the end portion of the first rod 112.

It should be noted that the first and second pistons 118,128 and the first and second end caps 130,136 guide the first and second rods 112,114 along the longitudinal axis 116 and prevent cocking and binding of the first and second rods 112,114 relative to the body 110. A first stop 170 is disposed about the first rod 112 at a location between the first piston 118 and the first end cap 130. The first stop 170 engages the rod end 148 of the first piston 118 and the first end cap 130 at the second position of the piston 118. Similarly, a second stop 172 is disposed about the second rod 114 at a location between the second piston 128 and the second end cap 136. The second stop 172 engages the rod end 148 of the second piston 128 and the second end cap 136 at the second position of the second piston 128.

Figure 4:
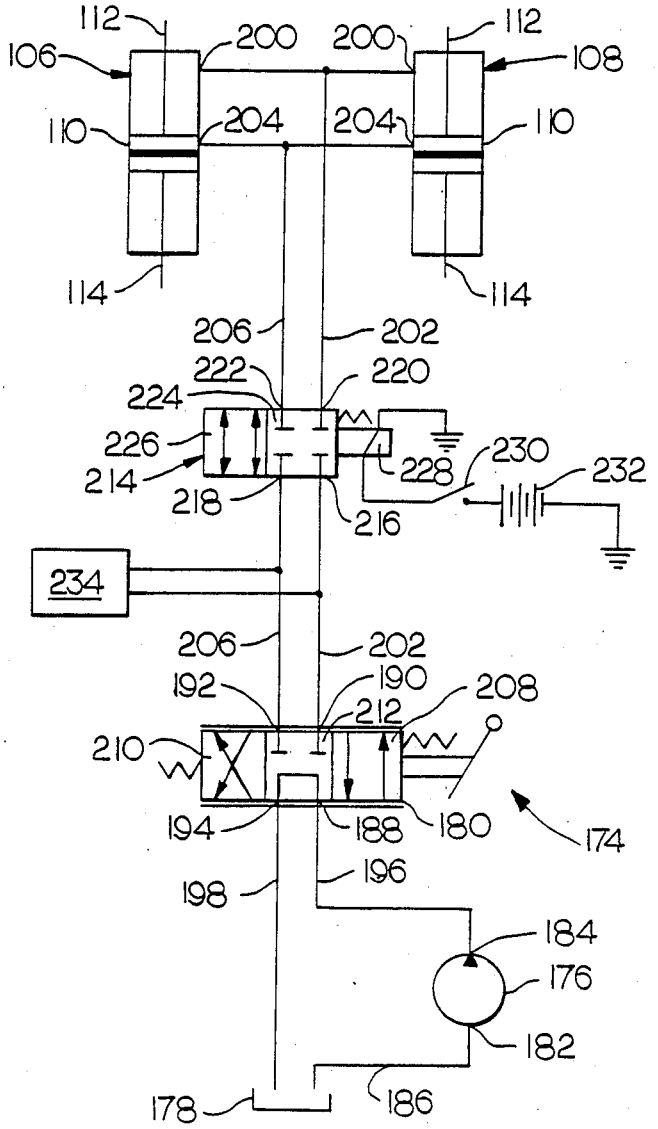
FIG. 4 is a diagrammatic schematic representation of a pressurized fluid flow delivering means which controllably selectively delivers pressurized fluid flow to the third and fourth link assemblies.

Referring to FIG. 4, means 174 is provided for selectively delivering pressurized fluid flow to the first chamber 142 of the third and fourth link assemblies 106,108 and controllably move the first piston 118 between said first and second positions. Selective delivering means 174 includes a source of pressurized fluid flow 176, a reservoir 178, and a control valve 180. The source 176 has an inlet port 182 and an outlet port 184. The inlet port 182 is connected to reservoir 178 via a conduit 186. The control valve 180 has an inlet port 188, first and second outlet ports 190,192, and a drain port 194. The outlet port 184 of source 176 is connected to inlet port 188 of control valve 180 by a conduit 196, and drain port 194 is connected to reservoir 178 via a conduit 198. First outlet port 190 is connected to a first port 200 in body 110 of the third and fourth link assemblies 106,108 by a conduit 202, and the second outlet port 192 is connected to a second port in body 110 opening in body 110 at a location between the head end 146 of piston 118 and the dividing member 140 by conduits 206.

The control valve 180 has a first position 208, a second position 210, and a neutral position 212 located between the first and second positions 208,210. The control valve 180 is an infinitely variable type and shiftable between the neutral position 212 and the first and second positions 208,210. The control valve 180 is normally spring biased to the neutral position. The control valve 180 connects inlet port 188 to the first outlet port 190, and the second outlet port 192 to the drain port 194 at the first position 208 and connects the inlet port 188 to the second outlet port 192, and the first outlet port 190 to the drain port 194 at the second position 210. At the neutral position 212, the inlet port 188 is connected to the drain port 194, and the first and second outlet ports 190,192 are blocked from the inlet and drain ports 188,194.

A selector valve 214 having first and second inlet ports 216,218 and first and second outlet ports 220,222 is disposed in conduits 202,206 between the control valve 180 and the bodies 110 of the third and fourth link assemblies 106,108. The selector valve first inlet and outlet ports 216,220 are connected to conduit 202, and the selector valve second inlet and outlet ports 218,222 are connected to conduit 206. The selector valve 214 has first and second positions 224,226 and is shiftable by a solenoid 228 between the first and second positions 224,226. The selector valve 214 is normally spring biased to the first position 224 at which the first and second inlet ports 216,218 are blocked from the first and second outlet ports 220,222 and shiftable by the solenoid 228 to the second position 226 at which the first inlet port 216 is connected to the first outlet port 220, and the second inlet port 218 is connected to the second outlet port 222. An electrical switch 230, which is connected to and between the solenoid valve and a source of electrical current 232, determines the position of the selector valve 214. With switch 230 closed, the selector valve 214 will be at the second position 226.

Additional work systems 234, such as container spread, slew, clamp, release, and the like are supplied pressurized fluid flow from source 176 via control valve 180 in a similar manner as the third and fourth link assemblies 106,108. Therefore, without the selector valve 214, undesirable actuation of the third and fourth link assemblies would take place when the control valve was actuated to operate the other work systems.

INDUSTRIAL APPLICABILITY

With reference to FIGS. 1–4, in operation, the material handling vehicle operator positions the vehicle so that the load engaging frame 36 is squarely positioned above the load 58 to be lifted. Upon acquiring acceptable position, the vehicle operator will lower the carriage assembly 26 by retracting lift jacks 24 until the load engaging frame 36 engages load 58. In situations where the load 58 is not level (parallel) with the bottom 54 of the load engaging frame 36, the freely movable rods 100,114 of the first, second, third, and fourth link assemblies 82,84,106,108 will retract as necessary and permit relative elevational movement of the load engaging frame 36 at locations of noncontact with the top of the load 58 until contact is made. When the entire load engaging frame 36 is at rest on the load 58, the operator will cease elevational movement and engage and mate the twist locks 62 with the locking portions of the container 58.

It is to be noted that in applications where the load 58 is a trailer, the need for engaging the load engaging frame 36 with the top of the trailer 58 is not required because the clamps 64 are used rather than the twist lock 62. When the load 58 is a trailer, the operator places the load engaging frame 36 over the trailer to be lifted in the same manner as previously discussed, rotates the clamp arm 74 from the stored position to the operative position by retracting jacks 76 to the position shown in FIG. 2, and the clamp arms 74 from the releasing position to the trailer clamping position as shown in solid lines in FIG. 1 by moving the jacks 78 to the extended position.

When the load 58 is connected to the load engaging frame 36 by either the twist locks 62 or the clamp arm 74 as heretofore discussed, the operator then raises the load 58 from the surface upon which it is at rest and maneuvers the vehicle 10 to a location spaced from the at rest position of the load 58. The operator then elevationally positions the load 58 at the proper height by actuation of lift jacks 24 for transportation purposes.

At a deposit location of the load 58, the operator raises the load 58 to an adequate height by elevationally moving the carriage 26 on the lift mast 12. He then positions the load 58 accurately above the deposit location by manipulation of the vehicle 10 and load engaging frame 36 in a normal and usual manner, and then lowers the carriage 26 until the load 58 is at rest at the selected location.

In applications where the load 58 is a container, the twist locks 62 are rotated to the unlocking positions relative to the container, and the carriage 26 is elevationally raised so that the load engaging frame 36 is free from contact with the container 58. The operator is then free to withdraw the vehicle 10 from the load deposit location and perform other material handling functions in the usual and customary manner. It is to be noted that the free movement of the first, second, third, and fourth link assemblies 82,88,106,108 also assist in lowering of the container onto an unlevel surface by enabling the operator to fully place the container 58 at rest on the surface of the deposit location in a precise and easily controllable manner.

When the load 58 is a trailer, the same steps for depositing the trailer 58 at the desired location are followed as outlined above with respect to the container with the following exceptions. The operator positions the ball 60 of the trailer above the stantion on the railroad car, lowers the carriage 26 until the trailer 58 is closely above the stantion, and extends the first rod 112 of the third and fourth link assemblies 106,108 to engage the ball with the stantion. To extend the first rods 112, pressurized fluid flow must be directed to the second port 204 of the third and fourth link assemblies 106,108. To achieve this, the operator must close switch 230 to shift the selector valve 214 to the second position 226 and shift the control valve 180 to the second position 210. The operator then positions the other end of the trailer at a desired attitude relative to the railcar by manipulating the connecting frame 36, load engaging frame 28, and maneuvering vehicle 10 in any appropriate and conventional manner. After completion of this task, the operator lowers the carriage until the other end portion of the trailer opposite the ball 60 is in contact with the railroad car and at rest on the car. The yieldable link assemblies 82,88,106,108 permit lowering of the load to the rest position without damaging the load and/or load lifting attachment 27.

Because the third and fourth link assemblies 106,108 provide both free and controlled elevational movement, both pick up and deposit of the load 58 is more accurate, requires less effort on the part of the operator, and increases the speed at which load pick up and deposit may be made. Subsequent to placing the load in the proper location, the operator actuates jacks 78 to the retracted position which moves the clamp arms 74 to the free position, as shown in phantom lines in FIG. 1. The operator is now free to raise the carriage 26 to elevationally clear the clamp arms from the trailer 58 and drive the vehicle to another location to pick up another load 58. The operator would also return the first rods 112 of the third and second link assemblies 106,108 to the retracted position at this time by shifting the control valve 180 to the first position 208 and the selector valve 214 to the second position 226.

In applications where the next load to be picked up is a container, the operator may, instead of clearing the clamp arms by raising the carriage 26, pivot the clamp arms about shaft 66 to the stored position through actuation of the first fluid operated jacks to the extended position which moves the clamp arms 74 to the stored position shown in FIG. 2. The operator is then free to maneuver the vehicle 10 to pick up the next load to be lifted.

Other aspects, objects, and advantages of this invention can be obtained from a study of the drawings, the disclosure, and the appended claims.

I claim:

1. A load lifting attachment, comprising:

a carriage having a connecting frame and being adapted to move between elevationally spaced apart locations;

a load engaging frame having first and second spaced apart end portions;

a plurality of load engaging members mounted on the load engaging frame;

a first link assembly having first and second spaced apart end portions and being pivotally connected at said first link assembly first end portion to the connecting frame and at said first link assembly second end portion to the load engaging frame first end portion, said first link assembly first and second end portions being freely elevationally movable relative to each other;

a second link assembly having first and second spaced apart end portions and being pivotally connected at said second link assembly first end portion to the connecting frame and at said second link assembly second end portion to the first end portion of the load engaging frame, said second link assembly first and second end portions being freely elevationally movable relative to each other;

means for connecting the load engaging frame second end portion to the connecting frame and maintaining said load engaging frame second end portion for free and controllably powered elevational movement relative to the connecting frame, said connecting means having a longitudinal axis extending between the load engaging and connecting frames, said connecting means being extensibly movable in directions along said longitudinal axis and said load engaging frame second end portion being elevationally movable in directions along said longitudinal axis in response to extensible movement of said connecting means along said longitudinal axis.

2. A load lifting attachment, as set forth in claim 1, wherein said load engaging frame second end portion connecting means includes:

a third link assembly having a body, a longitudinal axis, and first and second rods slidably connected to said body, said first and second rods each being extensibly movable along said longitudinal axis between an extended position and a retracted position relative to said body, said first and second rods each having an end portion, said first rod end portion being connected to one of the connecting and load engaging frames and said second rod end portion being connected to the other of said connecting and load engaging frames, one of said first and second rods being freely extensibly movable along said longitudinal axis between said extended and retracted positions, and the other of said first and second rods being controllably extensibly movable along said longitudinal axis between said extended and retracted positions;

a fourth link assembly having a body, a longitudinal axis, and first and second rods slidably connected to said body, said fourth link first and second rods each being extensibly movable along said fourth link longitudinal axis between an extended position and a retracted position relative to said fourth link body, said fourth link first and second rods each having an end portion, said fourth link first rod end portion being connected to one of the connecting and load engaging frames, and said fourth link second rod end portion being connected to the other of said connecting and load engaging frames, one of said fourth link first and second rods being freely extensibly movable along said fourth link longitudinal axis between said extended and retracted positions, and the other of said fourth link first and second rods being controllably extensibly movable along said fourth link longitudinal axis between said extended and retracted positions.

3. A load lifting attachment, as set forth in claim 2, wherein the body of each of said third and fourth link assemblies includes first and second spaced apart ends and a bore disposed in and opening at said body first and second ends, said third and fourth link assemblies each including:

a first end cap connected to said body first end;

a second end cap connected to said body second end; and a dividing member disposed in the body bore and being connected to the body at a location spaced from and between the first and second body ends, said dividing member defining first and second spaced apart chambers in said body, said first rod being disposed in the first chamber and said second rod being disposed in said second chamber, said first rod extending from said first chamber and past said first end cap, and said second rod extending from said second chamber and past said second end cap.

4. A load lifting attachment, as set forth in claim 3, wherein said dividing member seals said first chamber from being in fluid communication with said second chamber and prevents fluid transfer between said first and second chambers.

5. A load lifting attachment, as set forth in claim 3, wherein each of the third and fourth link assemblies include:

a first piston having a head end and a rod end and being connected to said first rod, said first piston being slidably disposed in said first chamber and movable between a first position at which the first piston head end is adjacent the dividing member, and a second position spaced from the first position at which the first piston rod end is adjacent the first end cap, said first rod being at the retracted position in response to the first piston being at the first position, and said first rod being at the extended position in response to the first piston being at the second position.

6. A load lifting attachment, as set forth in claim 5, wherein said third and fourth link assembly first rod end portion are pivotally connected to the connecting frame at spaced apart locations on the connecting frame, and said third and fourth link assembly second rod end portions are pivotally connected to the load engaging frame at spaced apart locations on the load engaging frame second end portion.

7. A load lifting attachment, as set forth in claim 6, wherein said first and second link assemblies each have a longitudinal axis, said first, second, third, and fourth link assemblies being spaced from each other in a direction transverse to the longitudinal axis of each of the first, second, third, and fourth link assemblies.

8. A load lifting attachment, as set forth in claim 5, wherein said third and fourth link assemblies each include:

a second piston being connected to said second rod, disposed in said second chamber, and slidably engageable with said body;

a first aperture disposed in said first end cap, said first rod being slidably disposed in said first aperture; and a second aperture disposed in said second end cap, said second rod being slidably disposed in said second aperture, said first piston and first end cap guiding said first rod along said longitudinal axis between said extended and retracted positions, and said second piston and second end cap guiding said second rod along said longitudinal axis between said extended and retracted positions.

9. A load lifting attachment, as set forth in claim 5, including means for selectively delivering pressurized fluid flow to the first chamber of the third and fourth link assemblies and controllably moving said first piston of the third and fourth link assemblies between said first and second positions.

10. A load lifting attachment, as set forth in claim 9, wherein said selective delivering means includes:

a source of pressurized fluid flow;

a control valve having first and second fluid directing positions and being connected to said source of pressurized fluid flow and said third and fourth link assembly bodies, said control valve being adapted to pass pressurized fluid flow from said source to at least one of said first chambers at a first location between the piston rod end and said first end cap in response to said control valve being at said first fluid directing position, and said control valve being adapted to pass pressurized fluid flow from said source to at least one of said first chambers at a second location between the piston head end and said dividing member in response to said control valve being at said second position.

11. A load lifting attachment, as set forth in claim 10, wherein said control valve is adapted to pass pressurized fluid flow simultaneously to the first chambers of said third and fourth link assemblies, and said selective delivering means includes a selector valve having a fluid blocking position and a fluid passing position and being connected to said control valve and said third and fourth link assembly bodies, said selector valve being movable between said fluid passing position at which the pressurized fluid flow passed by said control valve is directed to the first chamber of said third and fourth link assembly bodies and said fluid blocking position at which the pressurized fluid flow passed by said control valve is blocked from passing to the first chamber of said third and fourth link assembly bodies.

12. A material handling vehicle, comprising:

a vehicle end portion;

a lift mast having a pair of spaced apart upright members and being pivotally connected to the vehicle end portion;

a carriage having a connecting frame and being mounted on said pair of upright members, said carriage being movable along said pair of upright members between elevationally spaced apart locations on said pair of upright members, said connecting frame having an arm portion projecting from said lift mast in a direction transverse to the pair of upright members;

a load engaging frame;

a plurality of spaced apart load engaging members pivotally connected to said load engaging frame at spaced apart locations on said load engaging frame;

first link assembly having a body, a longitudinal axis, and a rod slidably connected to said first link assembly body and movable relative to said first link assembly body along said longitudinal axis between an extended position and a retracted position relative to said first link assembly body, said first link assembly rod being pivotally connected to one of the arm portion and load engaging frame, said first link assembly body being pivotally connected to the other one of the arm portion and load engaging frame;

second link assembly having a body, a longitudinal axis, and a rod slidably connected to said second link assembly body and movable relative to said second link assembly body along said longitudinal axis between an extended position and a retracted position relative to said second link assembly body, said second link assembly rod being pivotally connected to one of the arm portion and load engaging frame, said second link assembly body being pivotally connected at said second link assembly body to the other one of the arm portion and load engaging frame;

a third link assembly having a body, a longitudinal axis, and first and second rods slidably connected to said body, said third link assembly first and second rods each being extensibly movable along said third link assembly longitudinal axis between an extended position and a retracted position relative to said third link assembly body, said third link assembly first and second rods each having an end portion, said third link assembly first rod end portion being pivotally connected to one of the arm portion and load engaging frame, and said third link assembly second rod end portion being pivotally connected to the other of said arm portion and load engaging frame, one of said third link assembly first and second rods being freely extensibly movable along said third link assembly longitudinal axis between said extended and retracted positions, and the other of said third link assembly first and second rods being controllably extensibly movable along said third link assembly longitudinal axis between said extended and retracted positions;

a fourth link assembly having a body, a longitudinal axis, and first and second rods slidably connected to said fourth link assembly body, said fourth link assembly first and second rods each being extensibly movable along said fourth link assembly longitudinal axis between an extended position and a retracted position relative to said fourth link assembly body, said fourth link assembly first and second rods each having an end portion, said fourth link assembly first rod end portion being pivotally connected to one of the arm portion and load engaging frame and said fourth link assembly second rod end portion being pivotally connected to the other one of said arm portion and load engaging frame, one of said fourth link assembly first and second rods being freely extensibly movable along said fourth link assembly longitudinal axis between said extended and retracted positions, and the other one of said fourth link assembly first and second rods being controllably extensibly movable along said fourth link assembly longitudinal axis between said extended and retracted positions; and means for selectively delivering pressurized fluid flow to the third and fourth link assemblies and controllably moving said first rod of the third and fourth link assemblies between said extended and retracted positions, said loading engaging frame being elevationally movable relative to said connecting frame and in a direction along the axis of the third and fourth link assemblies in response to a change in the magnitude of extension of the third and fourth link assemblies.

13. A material handling vehicle, as set forth in claim 12, wherein said first, second, third and fourth link assemblies are spaced from each other at said pivotal connections to the arm portion and at said pivotal connections to the load engaging frame.

14. A material handling vehicle, as set forth in claim 13, wherein said first and second link assembly bodies being universally pivotally connected to the connecting frame, said first and second link assembly rods being universally pivotally connected to the load engaging frame, said third and fourth link assembly first rod end portions being universally pivotally connected to the arm portion, and said third and fourth link assembly second rod end portions being universally pivotally connected to the load engaging frame.

15. A material handling vehicle, as set forth in claim 13, wherein said load engaging frame has first and second spaced apart end portions, said load engaging members being pivotally connected to said load engaging frame at spaced apart locations on said load engaging frame, and said first and second link assemblies being pivotally connected to the load engaging frame first end portion at spaced apart locations on the load engaging frame first end portion, and said third and fourth link assemblies being pivotally connected to the load engaging frame second end portion at spaced apart locations on the load engaging frame second end portion.

16. A material handling vehicle, as set forth in claim 13, wherein the third and fourth link assembly bodies each have first and second ends and a bore disposed in the third and fourth link assembly bodies and opening at said first and second body ends, said third and fourth link assemblies each including:

a first end cap having a first aperture disposed therein and being connected to the body first end;

a second end cap having a second aperture disposed therein and being connected to the body second end;

a dividing member disposed in the body bore and being connected to the body at a location spaced from and between the first and second body ends, said dividing member defining first and second spaced apart chambers with said body;

a first piston being mounted on the first rod and being slidably disposed in the first chamber; and a second piston being mounted on said second rod and being slidably disposed in the second chamber, said first rod being slidably disposed in said first aperture and extending from the first chamber and past the first end cap, and said second rod being slidably disposed in said second aperture and extending from the second chamber and past the second end cap.

17. A material handling vehicle, as set forth in claim 16, wherein said first piston of each of the third and fourth link assemblies has a rod end and a head end and said selective delivering means includes:

first and second spaced apart ports disposed in the body of each of said third and fourth link assemblies, said first ports each opening into the first chamber at a location between the first piston rod end and the first end cap, and said second ports each opening into the first chamber at a location between the first piston head end and the dividing member;

a reservoir;

a source of pressurized fluid flow having an inlet port and an outlet port and being connected at said inlet port to said reservoir;

a control valve having first and second positions, an inlet port, first and second outlet ports, and a drain port, said control valve being connected at said control valve inlet port to the source outlet put, at the drain port to the reservoir, and at the first and second control valve outlet ports to the first and second ports of the third and fourth link assemblies, said control valve connecting the control valve inlet port to the control valve first outlet port at the first position of the control valve and the control valve inlet port to the control valve second outlet port at the second position of the control valve.

18. A material handling vehicle, as set forth in claim 17, wherein said selective delivering means includes a selector valve having first and second inlet ports, and first and second outlet ports, said selector valve first and second inlet ports being connected to the control valve first and second outlet ports, respectively, and said first and second selector valve outlet ports being connected to the first and second ports of the third and fourth link assemblies, said selector valve having first and second positions and being movable between said first and second positions, said selector valve first and second inlet ports being blocked from said selector valve first and second outlet ports at the selector valve first position and said selector valve first and second inlet ports being connected to the selector valve first and second outlet ports, respectively, at the selector valve second position.

* * * * *